US009632479B2

(12) United States Patent
Maeshima et al.

(10) Patent No.: US 9,632,479 B2
(45) Date of Patent: Apr. 25, 2017

(54) PROCESS CARTRIDGE AND IMAGE FORMING APPARATUS

(71) Applicant: CANON KABUSHIKI KAISHA, Tokyo (JP)

(72) Inventors: Hideki Maeshima, Mishima (JP); Masato Tanabe, Susono (JP); Keisuke Nomura, Suntou-gun (JP); Hiroki Shimizu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/695,219

(22) Filed: Apr. 24, 2015

(65) Prior Publication Data

US 2016/0018784 A1 Jan. 21, 2016

Related U.S. Application Data

(62) Division of application No. 14/104,584, filed on Dec. 12, 2013, now abandoned.

(30) Foreign Application Priority Data

Dec. 14, 2012 (JP) ..... 2012-273206

(51) Int. Cl.
*G03G 21/18* (2006.01)

(52) U.S. Cl.
CPC ..... *G03G 21/1857* (2013.01); *G03G 21/185* (2013.01); *G03G 21/1821* (2013.01); *G03G 2221/1861* (2013.01)

(58) Field of Classification Search
CPC ..... G03G 21/1817; G03G 21/1821; G03G 21/1825; G03G 21/1857; G03G 21/186;
(Continued)

(56) References Cited

U.S. PATENT DOCUMENTS 6,947,686 B2 9/2005 Kawai et al.
6,968,142 B2 11/2005 Arimitsu et al.
(Continued)

FOREIGN PATENT DOCUMENTS

JP 2008-170944 7/2008
JP 2009216802 9/2009
JP 2011257783 12/2011

*Primary Examiner* — Sophia S Chen
(74) *Attorney, Agent, or Firm* — Fitzpatrick, Cella, Harper & Scinto

(57) ABSTRACT

A process cartridge for an image forming apparatus includes a drum unit supporting a photosensitive drum; a developing roller; a driving roller for driving the roller; a drive receiving portion; a developing unit supporting the developing roller and the driving roller; and a connecting portion connecting the drum unit and the developing unit, the connecting portion being disposed below the driving roller. The developing unit is movable relative to the drum unit by rotating about the connecting portion between a contacting position in which the drum and the developing roller contact each other and a spacing position in which the drum and the developing roller are spaced from each other. A direction of the receiving portion is opposite to that of the developing roller, and is the same as the developing unit rotation from the spacing position toward the contacting position.

5 Claims, 10 Drawing Sheets

(58) Field of Classification Search
CPC ... G03G 2221/1853; G03G 2221/1861; G03G 21/185
USPC ..... 399/111, 113
See application file for complete search history.

(56) References Cited

U.S. PATENT DOCUMENTS

| | | | |
|---|---|---|---|
| 6,980,758 | B2 | 12/2005 | Murayama et al. |
| 7,046,942 | B2 | 5/2006 | Arimitsu et al. |
| 7,072,594 | B2 | 7/2006 | Hoshi et al. |
| 7,072,603 | B2 | 7/2006 | Tsuzuki et al. |
| 7,088,939 | B2 | 8/2006 | Maeshima et al. |
| 7,127,194 | B2 | 10/2006 | Hoshi et al. |
| 7,158,735 | B2 | 1/2007 | Murayama et al. |
| 7,162,181 | B2 | 1/2007 | Maeshima et al. |
| 7,340,197 | B2 | 3/2008 | Murayama et al. |
| 7,349,649 | B2 | 3/2008 | Hoshi et al. |
| 7,715,746 | B2 | 5/2010 | Tanabe et al. |
| 7,813,671 | B2 | 10/2010 | Nittani et al. |
| 7,894,733 | B2 | 2/2011 | Tanabe et al. |
| 7,926,934 | B2 | 4/2011 | Tanabe |
| 7,953,340 | B2 | 5/2011 | Tanabe et al. |
| 7,976,151 | B2 | 7/2011 | Tanabe |
| 8,213,828 | B2 | 7/2012 | Murayama et al. |
| 8,272,795 | B2 | 9/2012 | Tanabe et al. |
| 8,301,054 | B2 | 10/2012 | Tanabe et al. |
| 8,369,743 | B2 | 2/2013 | Maeshima et al. |
| 8,565,639 | B2 | 10/2013 | Nittani et al. |
| 8,583,006 | B2 | 11/2013 | Murayama et al. |
| 8,688,003 | B2 | 4/2014 | Maeshima et al. |
| 2008/0138115 | A1 | 6/2008 | Chadani et al. |
| 2008/0175623 | A1 | 7/2008 | Jeon |
| 2009/0226209 | A1 | 9/2009 | Shiraki et al. |
| 2009/0297213 | A1 | 12/2009 | Satomura |
| 2010/0054798 | A1* | 3/2010 | Sato ..... G03G 21/1832 399/111 |
| 2010/0209138 | A1 | 8/2010 | Tani |
| 2013/0223853 | A1 | 8/2013 | Chadani et al. |
| 2013/0272727 | A1 | 10/2013 | Hirukawa et al. |
| 2013/0308978 | A1 | 11/2013 | Nittani et al. |

* cited by examiner

PROCESS CARTRIDGE AND IMAGE FORMING APPARATUS

FIELD OF THE INVENTION AND RELATED ART

The present invention relates to a process cartridge detachably mountable to an image forming apparatus and an image forming apparatus comprising the process cartridge. The image forming apparatus forms an image on a recording material using an image forming process. Examples of the image forming apparatus include an printer, a copying machine, a facsimile machine, a wordprocessor and a complex machine having a plurality of functions of such machines.

Conventionally, in an image forming apparatus using an electrophotographic image forming process, a photosensitive drum and process means actable on the photosensitive drum are unified into a cartridge. The cartridge is detachably mountable to a main assembly of the image forming apparatus (process cartridge type).

Using the process cartridge type, the maintenance operations for the image forming apparatus can be performed by the user without relying on a service person, and therefore, the operationality can be improved remarkably, and the process cartridge type is widely used in an image forming apparatus.

Japanese Patent 4464435 discloses an in-line type image forming apparatus in which a plurality of process cartridges are arranged in a line. Here, a process cartridge comprises a drum unit including the photosensitive drum, and a developing unit including a developing roller, wherein the drum unit and the developing unit are connected rotatably about a swing center.

The photosensitive drum is provided with a drum coupling at one end portion side of-the photosensitive drum with respect to the axial direction of the photosensitive drum, and when the process cartridge is mounted to the main assembly of the apparatus, the drum coupling is engaged with a main assembly coupling provided in the main assembly of the apparatus to receive a driving force.

The developing roller is provided with an Oldham coupling as a shaft coupling member at one end portion side of-the developing roller with respect to the axial direction of the developing roller. When the process cartridge is mounted to the main assembly of the apparatus, a driving side engaging portion of the Oldham coupling is engaged with a main assembly development coupling provided in the main assembly of the apparatus to transmit the driving force to the developing roller.

Recently, a further image quality improvement of the image forming apparatus is desired. In a conventional example, a position of a rotational center of the developing unit, a position of the drive inputting portion and a rotational moving direction thereof are so selected that an urging force of the developing roller to the photosensitive drum by the weight of the developing unit and the driving force of the drive inputting portion of the developing unit decreases.

With such a structure, when the driving force is transmitted to the developing roller, the urging force of the developing roller to the photosensitive drum may be unstable.

The present invention is a further development of the prior-art structure.

Accordingly, it is an object of the present invention to provide a process cartridge and an image forming apparatus in which a contact force of the developing roller to the photosensitive drum is stabilized.

According to an aspect of the present invention, there is provided a process cartridge detachably mountable to an image forming apparatus, said process cartridge comprising a photosensitive drum: a photosensitive unit rotatably supporting said photosensitive drum; a rotatable developing roller for developing an electrostatic latent image on said photosensitive drum; a driving roller for driving said developing roller; a drive receiving portion, provided below one end portion side of a shaft of said driving roller, for receiving a driving force from the image forming apparatus; a developing unit supporting said developing roller and said driving roller; and a connecting portion connecting said photosensitive unit and said developing unit, said connecting portion being disposed below said driving roller with respect to the direction of gravity in a state that said process cartridge is mounted to the image forming apparatus, wherein said developing unit is movable relative to said photosensitive unit by rotating about said connecting portion between a contacting position in which said photosensitive drum and said developing roller contact each other and a spacing position in which said photosensitive drum and said developing roller are spaced from each other, wherein a rotational moving direction of said drive receiving portion is opposite to that of said developing roller, and is the same as a direction of rotation of said developing unit from the spacing position toward the contacting position.

According to another aspect of the present invention, there is provided an image forming apparatus comprising a main assembly including a driving member for applying a driving force; a process cartridge detachably mountable to said main assembly, said process cartridge including a photosensitive drum, a photosensitive unit rotatably supporting said photosensitive drum, a rotatable developing roller for developing an electrostatic latent image on said photosensitive drum, a driving roller for driving said developing roller, a drive receiving portion, provided at one end portion side of a shaft of said driving roller, for receiving a driving force by connecting with said driving member; a developing unit supporting said developing roller and said driving roller, a connecting portion connecting said photosensitive unit and said developing unit, said connecting portion being disposed below said driving roller with respect to the direction of gravity in a state that said process cartridge is mounted to the image forming apparatus, wherein said developing unit is movable relative to said photosensitive unit by rotating about said connecting portion between a contacting position in which said photosensitive drum and said developing roller contact each other and a spacing position in which said photosensitive drum and said developing roller are spaced from each other, wherein a rotational moving direction of said drive receiving portion is opposite to that of said developing roller, and is the same as a direction of rotation of said developing unit from the spacing position toward the contacting position.

Further features of the present invention will become apparent from the following description of exemplary embodiments with reference to the attached drawings.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings.

(General Structure of Image Forming Apparatus)

Figure 1:
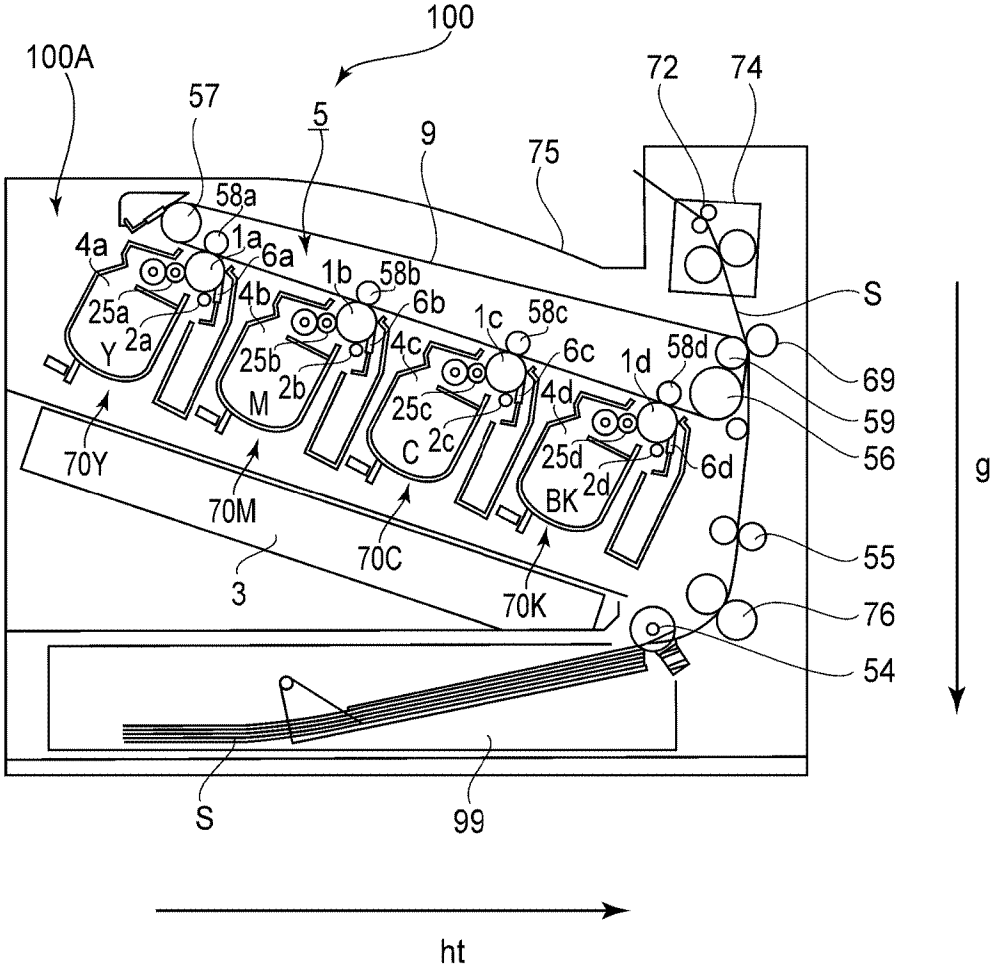
FIG. 1 is a principal sectional view of an image forming apparatus in an embodiment of the present invention.

FIG. 1 is a sectional view showing a general structure of an image forming apparatus 100 according to an embodiment of the present invention. As shown in FIG. 1, four process cartridges 70 (70Y, 70M, 70C, 70K) for executing a part of an image forming process are detachably mounted to a main assembly of the image forming apparatus 100. Incidentally, the process cartridges 70Y, 70M, 70C and 70K are collectively referred to as the process cartridge 70. In the following, also the members are similarly described. Further, an upstream side of the process cartridge 70 with respect to a mounting direction of the image forming apparatus 100 is defined as a front (surface) side, and a downstream side of the process cartridge 70 with respect to the mounting direction is defined as a rear (surface) side.

In FIG. 1, the respective process cartridges 70 are inclined and juxtaposed in an apparatus main assembly 100A with respect to a horizontal direction ht. Incidentally, a direction g in FIG. 1 is the direction of gravitation.

The process cartridge 70 includes a photosensitive drum 1 (1*a*, 1*b*, 1*c*, 1*d*) for bearing a toner image. At a periphery of the photosensitive drum 1, including a charging roller 2 (2*a*, 2*b*, 2*c*, 2*d*), a developing roller 25 (25*a*, 25*b*, 25*c*, 25*d*), and a cleaning member 6 (6*a*, 6*b*, 6*c*, 6*d*) are integrally provided.

The charging roller 2 electrically charges the surface of the photosensitive drum 1 uniformly, and the developing roller 25 develops a latent image, formed on the photosensitive drum 1, with a toner (developer) to visualize the latent image. The cleaning member 6 removes the toner remaining on the photosensitive drum 1 after a toner image formed on the photosensitive drum 1 is transferred onto a recording material (medium).

Further, below the process cartridges 70, a scanner unit 3 for forming the latent image on the photosensitive drums 1 by subjecting the photosensitive drums 1 to selective exposure to light on the basis of image information is provided.

At a lower portion of the apparatus main assembly 100A with respect to the direction g of gravitation, a cassette 99 in which sheets of the recording material S are accommodated is mounted. Further, a recording material conveying means is provided so that the recording material S can be conveyed to an upper portion of the apparatus main assembly 100A by being passed through a secondary transfer roller 69 and a fixing portion 74. That is, a feeding roller 54 for separating and feeding the sheets of the recording material S in the cassette 99 in a one-by-one manner, a conveying roller pair 76 for conveying the fed recording material S, and a registration roller pair 55 for synchronizing the latent image formed on the photosensitive drum 1 with the recording material S are provided.

Further, above the process cartridges 70, an intermediary transfer unit 5 onto which the toner image formed on each of the photosensitive drums 1 is to be transferred is provided. The intermediary transfer unit 5 includes a driving roller 56, a follower roller 57, primary transfer rollers 58 (58*a*, 58*b*, 58*c*, 58*d*) opposing the photosensitive drums 1 for the respective colors, and an opposite roller 59 opposing the secondary transfer roller 69 are provided. Around these rollers, a transfer belt 9 is extended and stretched. Further, the transfer belt 9 is circulated and moved so as to be contacted to all of the photosensitive drums 1, so that primary transfer of the toner images from the photosensitive drums 1 onto the transfer belt 9 is made. Then, by voltage application to the secondary transfer roller 69 and the opposite roller 59 disposed inside the transfer belt 9, the toner images are transferred from the transfer belt 9 onto the recording material S.

During image formation, while rotating the photosensitive drum 1, the photosensitive drum 1 uniformly charged by the charging roller 2 is subjected to selective exposure to light emitted from the scanner unit 3, so that an electrostatic latent image is formed on the photosensitive drum 1. The latent image is developed by the developing roller 25, so that the toner images of the respective colors (Y, M, C, Bk) are formed on the associated photosensitive drums 1, respectively.

In synchronism with this image formation, the registration roller pair 55 conveys the recording material S to a secondary transfer position where the secondary transfer roller 69 opposing the opposite roller 59 is contacted to the transfer belt 9. At this secondary transfer position, the respective color toner images are secondary-transferred from the transfer belt 9 onto the recording material S, so that a color image is formed on the recording material.

The recording material S on which the color image is formed is heated and pressed by the fixing portion 74, so that the color image (toner images) is fixed on the recording material S. Thereafter, the recording material S is discharged onto a discharge portion 75 by a (sheet-)discharging roller pair 72.

(Process Cartridge)

Next, the process cartridge 70 in this embodiment will be described with reference to FIGS. 2 to 4.

Figure 2:
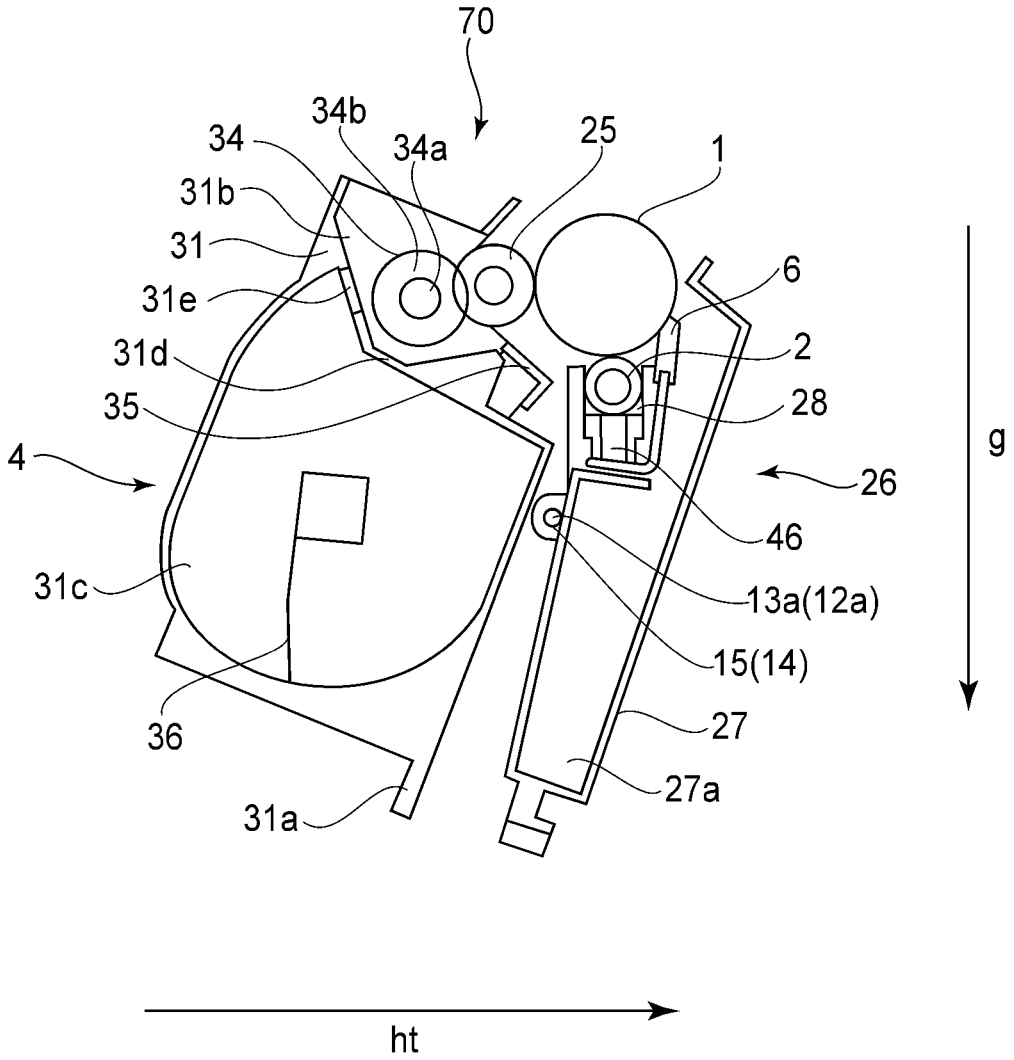
FIG. 2 is a principal sectional view of a process cartridge in the embodiment.
Figure 3:
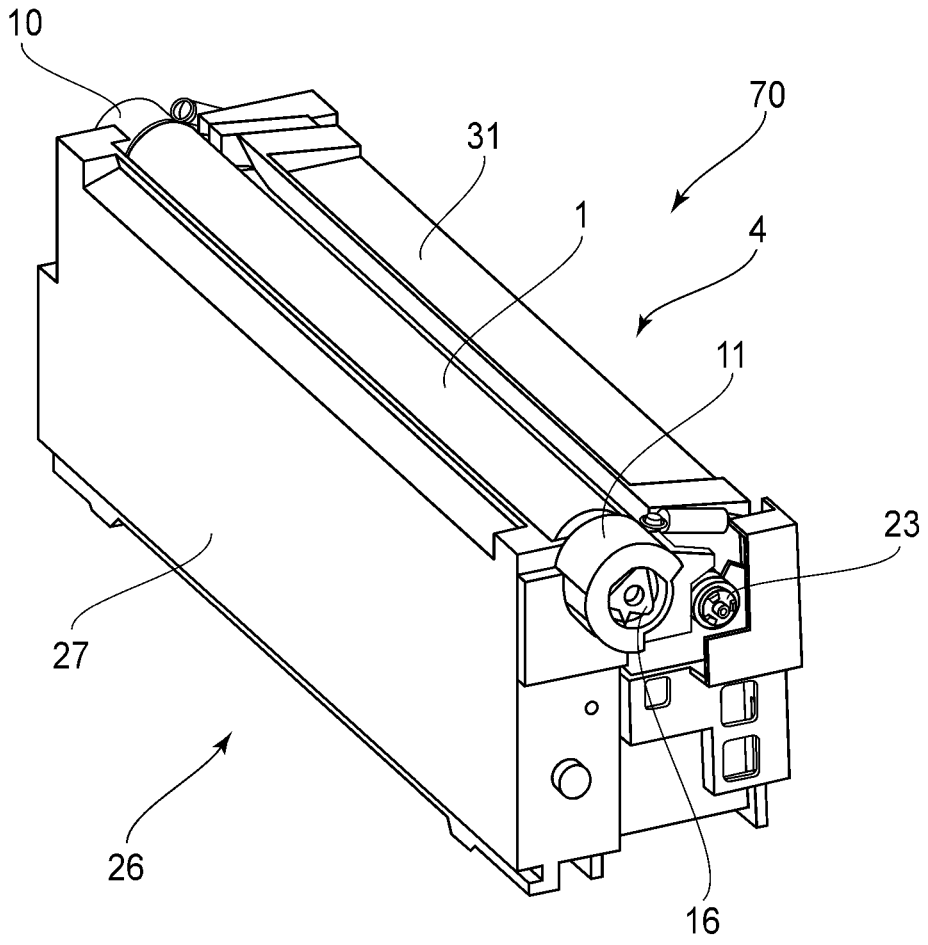
FIG. 3 is a general perspective view of the process cartridge in the embodiment.

FIG. 2 is a principal sectional view of the process cartridge 70 in which the toner is accommodated, and FIG. 3 is a perspective view of the process cartridge 70.

Incidentally, the process cartridge 70Y accommodating the toner of yellow (Y), the process cartridge 70M accommodating the toner of magenta (M), the process cartridge 70C accommodating the toner of cyan (C), and the process cartridge 70K accommodating the toner of black (Bk) have the same constitution.

The respective process cartridges 70 include photosensitive (drum) units 26 (26*a*, 26*b*, 26*c*, 26*d*) and developing units 4 (4*a*, 4*b*, 4*c*, 4*d*). The photosensitive unit 26 includes the photosensitive drum 1, the charging roller 2 and the cleaning member 6. Further, the developing unit 4 includes the developing roller 25.

To a cleaning frame 27 of the photosensitive unit 26, the photosensitive drum 1 is rotatably mounted via a front drum bearing 10 (FIG. 3) and a rear drum bearing 11 (FIG. 3). The photosensitive drum 1 is provided with a drum coupling 16 (FIG. 3) at an end portion thereof.

[Photosensitive Unit]

The cleaning member 6 provided on the peripheral side of the photosensitive drum 1 is constituted by an elastic member formed with a rubber blade and a cleaning supporting member. A residual toner removed from the surface of the photosensitive drum 1 by the cleaning member 6 falls into a removed toner chamber 27*a*.

By transmitting a driving force of a driving motor (not shown) to the photosensitive unit 26, so that the photosensitive drum 1 is rotationally driven depending on an image forming operation. The charging roller 2 is rotatably mounted to the photosensitive unit 26 via a charging roller bearing 28 and is urged against the photosensitive drum 1 by a charging roller urging member 46, thus being rotated by the rotation of the photosensitive drum 1.

[Developing Unit]

The developing unit 4 is constituted by the developing roller 25, rotated in contact with the photosensitive drum 1 and a developing device frame 31 for supporting the developing roller 25. Further, the developing unit 4 is constituted by a developing chamber 31*b* in which the developing roller 25 is disposed and toner accommodating chamber 31*c*, disposed below the developing chamber 31*b*, for accommodating the toner. These chambers are partitioned by a partition wall 31*d*. Further, the partition wall 31*d* is provided with an opening 31*e* through which the toner passes when the toner is fed from the toner accommodating chamber 31*c* to the developing chamber 31*b*.

The developing roller 25 is rotatably supported by the developing (device) frame 31 via a front developing (means) bearing 12 (FIG. 4) and a rear developing (means) bearing 13 (FIG. 4) provided in both sides of the developing device frame 31, respectively.

Further, on a peripheral surface of the developing roller 25, a developer supplying roller 34 rotatable in contact with the developing roller 25, and a developing blade 35 for regulating a toner layer on the developing roller 25 are provided. The developer supplying roller 34 is constituted by a metal-made developer supplying roller shaft 34*a* and a sponge portion 34*b*, and the sponge portion 34*b* is disposed in contact with the developing roller 25 with a predetermined penetration amount into the developing roller 25.

Further, in a toner accommodating chamber 31*c* in the developing frame 31, a toner feeding member 36 for feeding the toner into the developing chamber 31*b* through the opening 31*e* while stirring the toner accommodated in the toner accommodating chamber 31*c* is provided.

[Connection Between Photosensitive Unit and Developing Unit]

FIG. 3 is a general perspective view of the process cartridge 70. To the photosensitive unit 26, the developing unit 4 is rotatably mounted. A front supporting pin 14 and a rear supporting pin 15 (FIG. 2) which are press-fitted in the cleaning frame 27 are engaged with hand holes 12*a* and 13*a* (FIGS. 2 and 4), respectively, of the rear developing bearing 13 (FIG. 4). As a result, the developing unit 4 is rotatably supported by the cleaning frame 27 with the front supporting pin 14 and the rear supporting pin 15 are rotation shafts.

Further, the cleaning frame 27 is provided with a front drum bearing 10 and a rear drum bearing 11 which rotatably support the photosensitive drum 1. The rear drum bearing 11 supports a drum coupling 16 coupled to the photosensitive drum 1. Further, the front drum bearing 10 supports a flange. Here, the drum coupling 16 is a drum coupling member for transmitting a rotational force from the apparatus main assembly 100A to the photosensitive drum 1.

Figure 4:
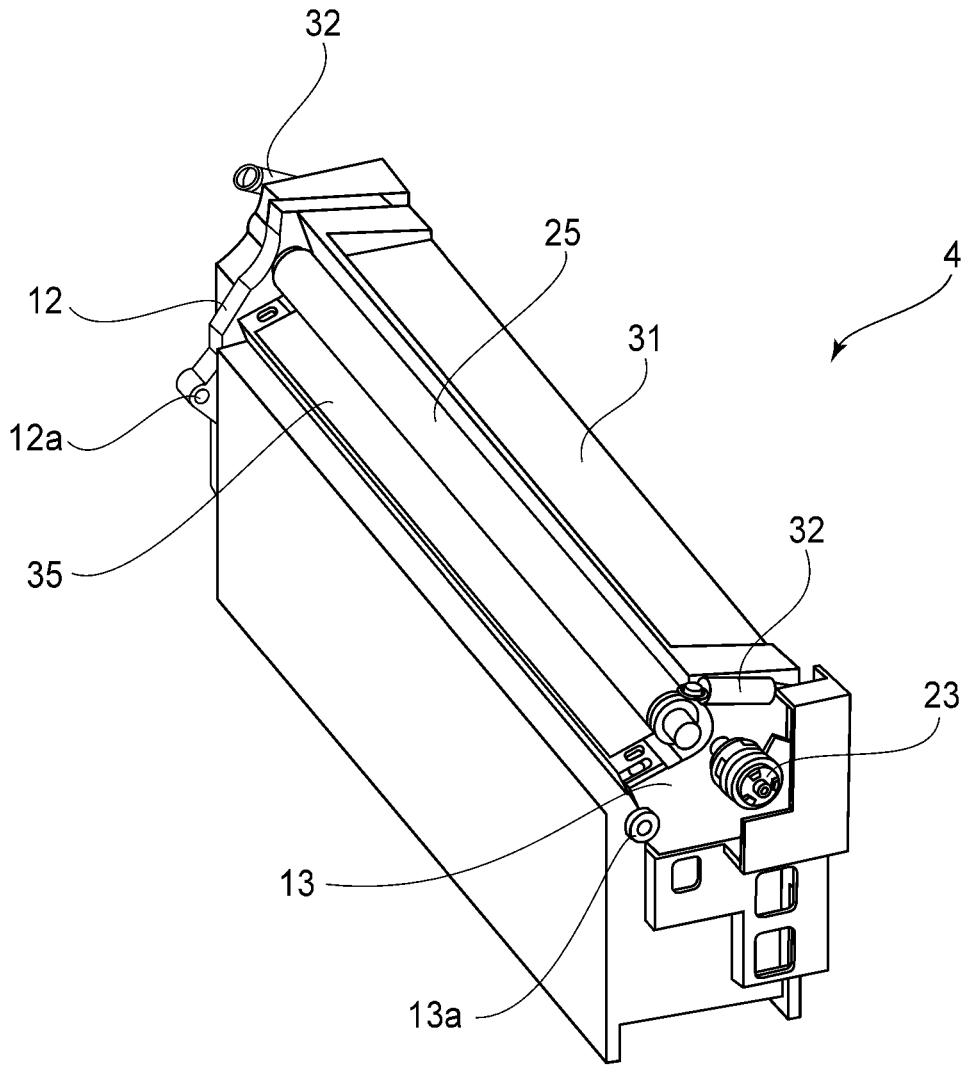
FIG. 4 is a general perspective view of a developing unit in the embodiment.

Further, FIG. 4 is a general perspective view of the developing unit 4. The developing frame 31 is provided with the front and rear developing bearings 12 and 13 for rotatably supporting the developing roller 25. Further, the developing unit 4 is constituted so as to be urged against the photosensitive unit 26, during image formation of the process cartridge 70, by an urging spring 32 provided at each of ends of the developing frame 31. By these urging spring 32, an urging force for bringing the developing roller 25 into contact with the photosensitive drum 1 with, as rotation centers, the hang holes 12*a* and 13*a* of the front and rear developing bearings 12 and 13 is generated.

(Insertion and Mounting of Process Cartridge into Image Forming Apparatus Main Assembly)

Figure 5:
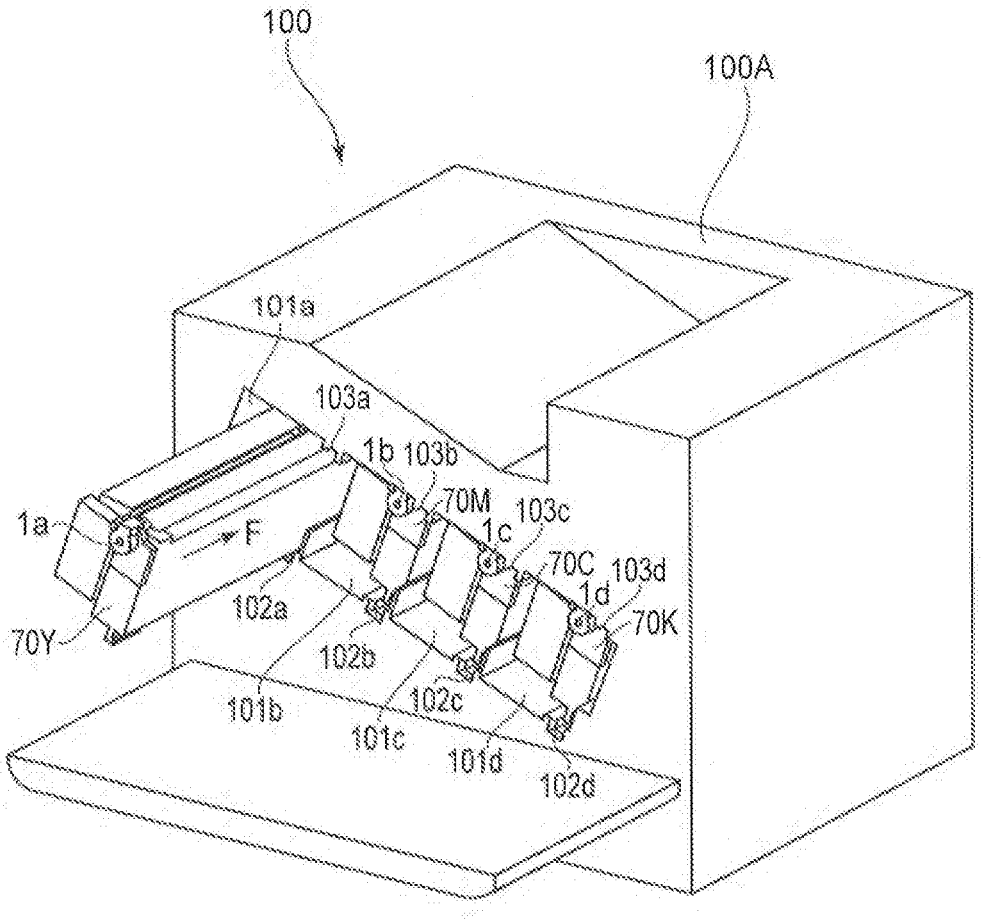
FIG. 5 is a perspective view showing a state in which a process cartridge is mounted to the image forming apparatus in the embodiment.

FIG. 5 is a perspective view showing a state in which the process cartridge 70 is mounted to the apparatus main assembly 100A of the image forming apparatus 100.

In this embodiment, a direction in which the process cartridge 70 is inserted through openings 101 (101*a*, 101*b*, 101*c*, 101*d*) of the image forming apparatus 100 is a direction (arrow F direction in the figure) parallel to an axial direction of the photosensitive drum 1.

In this embodiment, with respect to an insertion direction of the process cartridge 70, an upstream side is defined as a front side, and a downstream side is defined as a rear side. Further, in the image forming apparatus 100, a guide portion 103 (103*a*, 103*b*, 103*c*, 103*d*) is provided in an upper side, and a guide portion 102 (102*a*, 102*b*, 102*c*, 102*d*) is provided in a lower side. The process cartridge 70 is placed in a front side of the guide portion 102 with respect to a mounting direction and then is moved in the insertion direction indicated by the arrow F along the guide portions 102 and 103, thus being inserted into the image forming apparatus 100.

(Contact and Separation Embodiment Photosensitive Drum and Developing Roller)

A spacing mechanism between the photosensitive drum 1 and the developing roller 25 in the process cartridge 70 will be described with reference to FIGS. 6 and 7.

Figure 6:
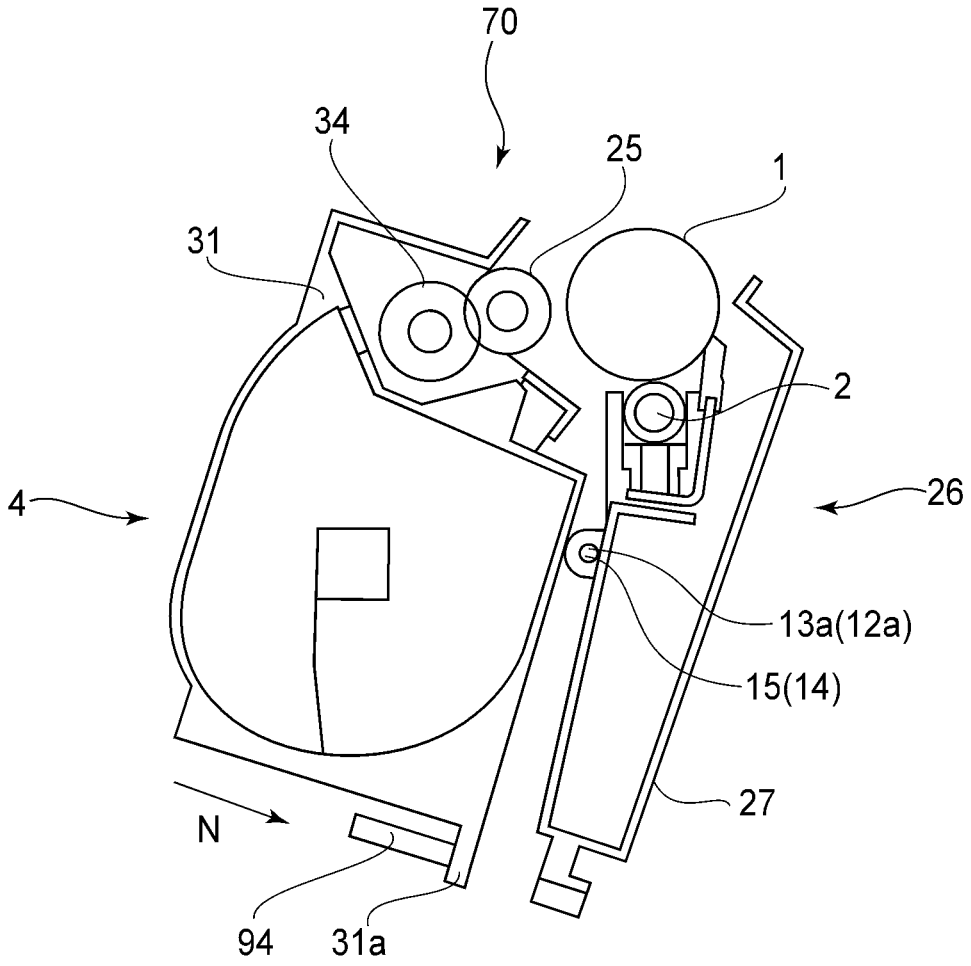
FIG. 6 is a sectional view for illustrating a spacing operation of the developing unit in the embodiment.

FIG. 6 is a sectional view showing the case where the photosensitive drum 1 and the developing roller 25 are spaced from each other. In FIG. 6, the apparatus main assembly 100A is provided with a spacing member 94 constituting a spacing means at a predetermined position with respect to a longitudinal direction of the process cartridge 70. In the developing unit 4, a spacing force receiving portion 31*a* of the developing frame 31 receives a force from the spacing member 94 moving in an arrow N direction, thus rotating the developing unit 4 in a rotational direction (second rotational direction) in which the developing unit 4 is spaced.

For this reason, the developing roller 25 is moved to a spaced position where the developing roller 25 is spaced from the photosensitive drum 1.

Figure 7:
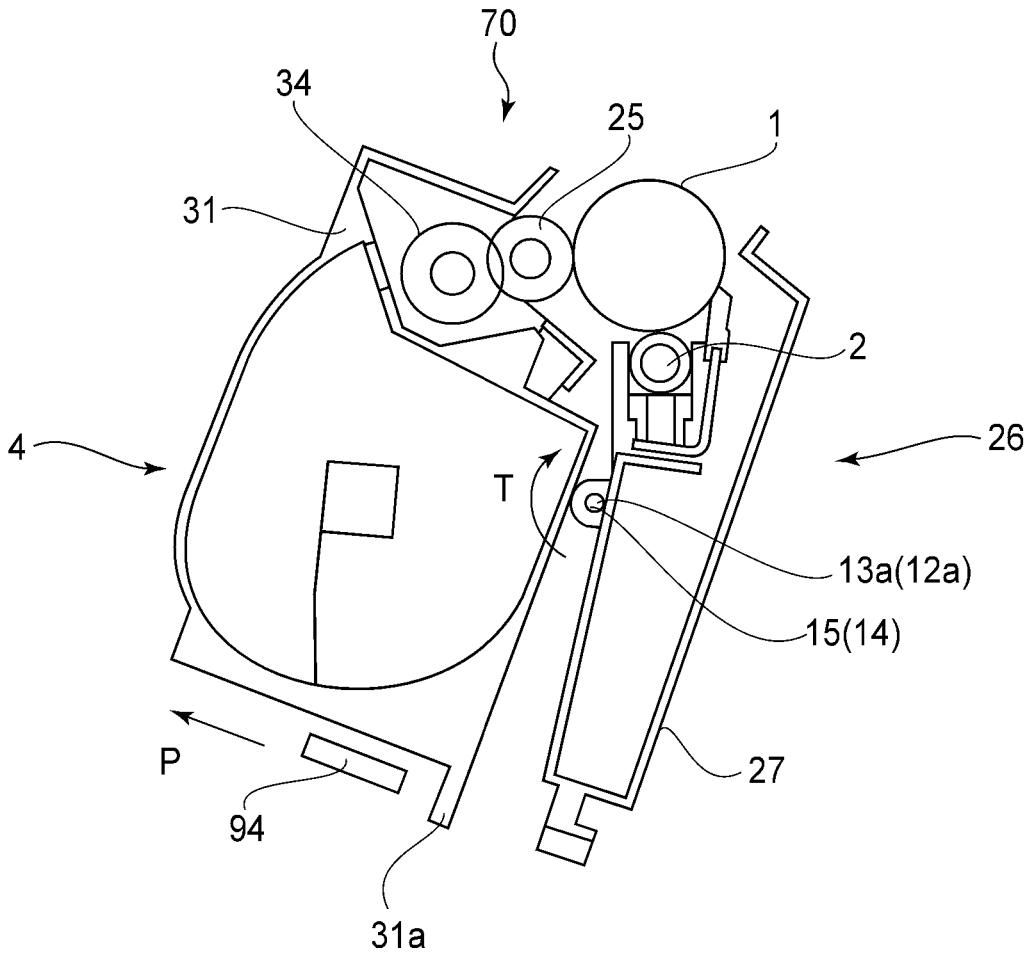
FIG. 7 is a sectional view for illustrating a contact operation of the developing unit in the embodiment.

FIG. 7 is a sectional view showing the case where the photosensitive drum 1 and the developing roller 25 are in contact with each other.

As shown in FIG. 7, when the spacing member 94 moves in an arrow P direction away from the spacing force receiving portion 31*a*, the developing unit 4 is rotated in an arrow T direction (first rotational direction) about the holes 12*a* and 13*a* of the front and rear developing bearings 12 and 13 by the urging force of the urging springs 32 (FIG. 4) provided at the ends of the developing frame 31. Then, the developing unit 4 is moved to a contact position, so that the developing roller 25 is contacted to the photosensitive drum 1.

By the spacing constitution shown in FIGS. 6 and 7, in a period other than during the image formation, the developing unit 4 is held at the spaced position shown in FIG. 6, so that the influence of deformation of the developing roller 25 on an image quality is suppressed.

(Relationship Between Developing Unit Rotation Center and Developing Drive Input Position and Rotational Direction)

Figure 8:
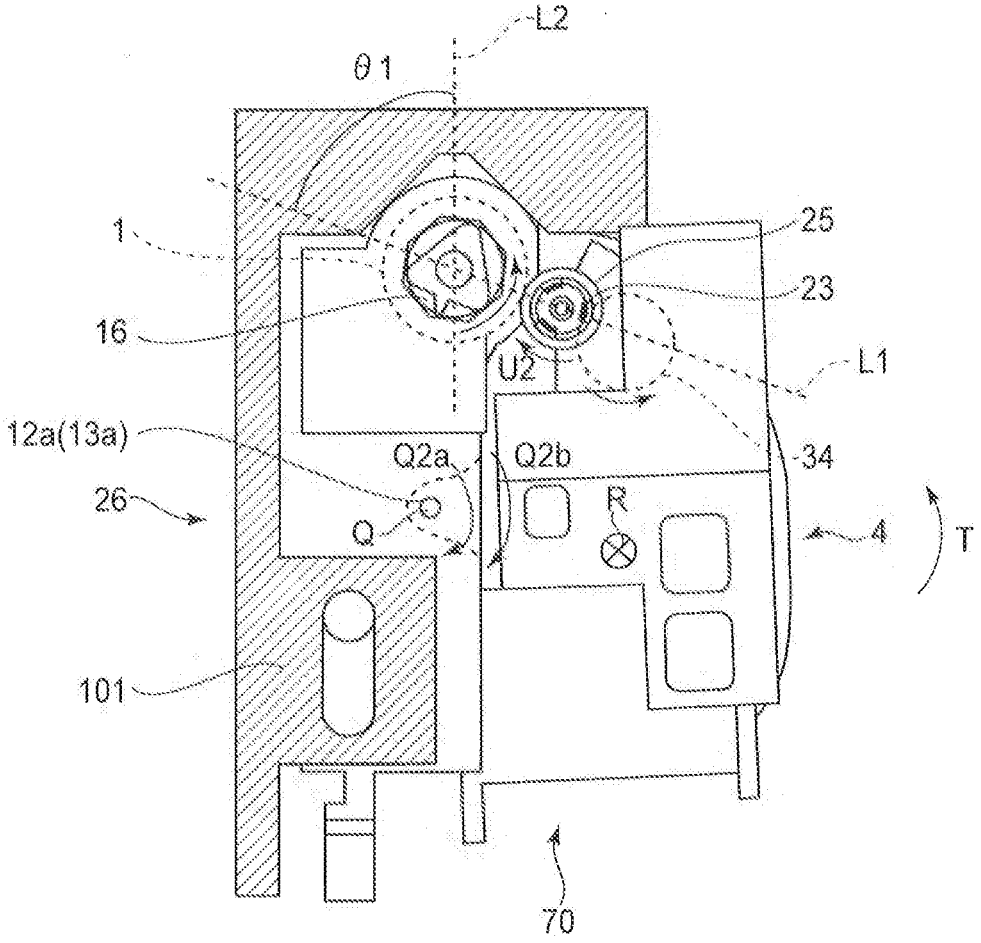
FIG.8 PRIOR ART
FIG. 8 is a side view for illustrating a relationship between a developing unit rotation center and developing drive input position and rotational direction in a conventional constitution.

A relationship between a rotational direction of a developing drive input in the process cartridge 70 and a rotation center position of the developing unit 4 will be described with reference to FIGS. 8 and 9. FIG. 8 is a side view for illustrating a relationship belt a developing unit rotation center and developing drive input position and rotational direction in a conventional constitution, and Figure is a side view for illustrating a relationship belt the developing unit rotation center and the developing drive input position and rotational direction in this embodiment.

First, a constitution of a conventional process cartridge will be described with reference to FIG. 8. Incidentally, in this conventional constitution, portions identical or similar to those in this embodiment are represented by the same reference numerals or symbols and will be omitted from redundant description.

FIG. 8 is a sectional view showing the process cartridge mounted to a mounting portion 101 of the image forming apparatus, and shows a state in which the developing roller 25 and the photosensitive drum 1 are in contact with each other. A rectilinear line L1 connecting a rotation shaft of the developing roller 25 with a rotation shaft of the photosensitive drum 1 and a rectilinear line L2 extending from the rotation shaft in the direction g of gravitation form a predetermined angle θ1 which is closer to 90 degrees. In a state in which the process cartridge is mounted to the image forming apparatus main assembly, a constitution in which a position of the photosensitive unit 26 is fixed and the developing unit 4 is rotated relative to the photosensitive unit 26 is employed.

Further, when centers, as the rotation center of the developing unit, of the holes 12*a* and 13*a* of the front and rear developing bearings 12 and 13 are taken as a rotation center Q (rotation shaft), the rotation center Q is disposed below the photosensitive drum 1 and the developing roller 25 with respect to the gravitation direction g. Further, when a position of the center of gravity of the developing unit 4 is taken as a barycentric position R, with respect to the gravitation direction g, the barycentric position R is disposed in the developing unit 4 side rather than the rotation center Q of the developing unit 4.

In this case, by the weight of the developing unit 4, a force of rotation moment Q2*a* shown in FIG. 8 is applied to the developing unit 4. By rotation of the developing unit 4 in an arrow T direction, the photosensitive drum 1 and the developing roller 25 are in contact with each other, and therefore an urging force of the developing roller 25 toward the photosensitive drum 1 acts in the arrow T direction. For that reason, rotation moment Q2*b* thereof is directed in a direction of decreasing the urging force of the developing roller 25 toward the photosensitive drum 1.

Further, in the conventional process cartridge, as shown in FIG. 8, a developing drive input portion is rotated in a rotational direction U2. For this reason, a force of rotation moment Q2*b* is applied to the developing unit 4. This direction is the direction of decreasing the urging force of the developing unit 4 toward the photosensitive drum 1.

Next, a constitution of the process cartridge in this embodiment of the present invention will be described with reference to FIG. 9.

Figure 9:
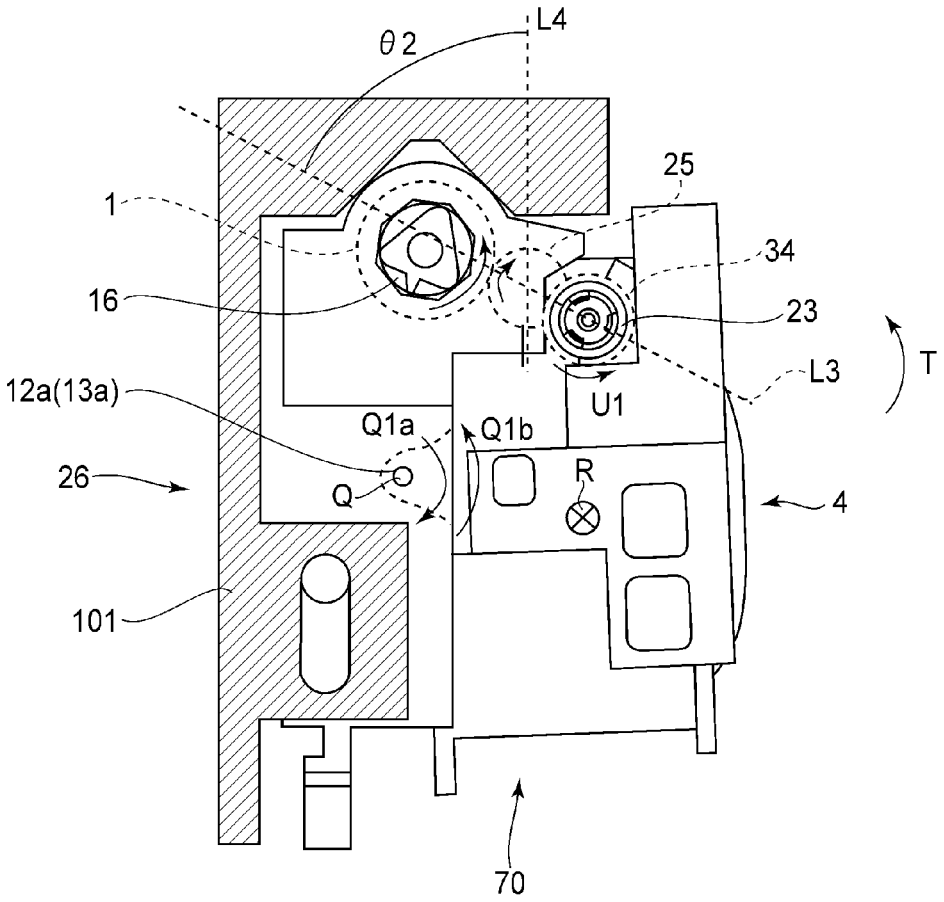
FIG. 9 is a side view for illustrating a relationship between a developing unit rotation center and developing drive input position and rotational direction in the embodiment.

FIG. 9 is a sectional view showing the process cartridge mounted to a mounting portion 101 of the image forming apparatus, and shows a state in which the developing roller 25 and the photosensitive drum 1 are in contact with each other. In a cross section shown in FIG. 9, a rectilinear line L3 connecting a rotation shaft of the developing roller 25 with a rotation shaft of the photosensitive drum 1 and a rectilinear line L4 extending from the rotation shaft in the direction g of gravitation form a predetermined angle θ2 which is closer to 90 degrees. In a state in which the process cartridge is mounted to the image forming apparatus main assembly, a constitution in which a position of the photosensitive unit 26 is fixed and the developing unit 4 is rotated relative to the photosensitive unit 26 is employed.

When centers, as the rotation center of the developing unit, of the holes 12*a* and 13*a* of the front and rear developing bearings 12 and 13 are taken as a rotation center Q, the rotation center Q is disposed below the photosensitive drum 1 and the developing roller 25 with respect to the gravitation direction g.

The developing roller 25 and the developer supplying roller 34 are rotatably supported by the developing unit 4. Further, the developer supplying roller 34 is provided, at a rotation shaft thereof, with a developing drive input portion 23 (driven portion), and the developing drive input portion 23 receives a rotational force from an outside to rotate the developer supplying roller 34. Further, the developer supplying roller 34 not only supplies the developer to the developing roller 25 but also transmits the rotational force received from the developing drive input portion 23. In this embodiment, a constitution in which the developer supplying roller 34 is contacted to and spaced from the developing roller 25 is not employed, but a constitution in which a contact state between the developer supplying roller 34 and the developing roller 25 is maintained is employed.

The urging springs 32 (FIG. 4) urge between the developing unit 4 and the photosensitive unit 26, so that the photosensitive drum 1 and the developing roller 25 are placed in the contact state. By rotation of the developing unit 4 in an arrow T direction, the photosensitive drum 1 and the developing roller 25 are in contact with each other, and therefore an urging force of the developing roller 25 toward the photosensitive drum 1 acts in the arrow T direction. Thus, by the contact between the photosensitive drum 1 and the developing roller 25, during the image formation, the developer is supplied from the developing roller 25 to the peripheral side of the photosensitive drum 1.

On the other hand, during non-image formation, as described above with reference to FIGS. 6 and 7, from the outside of the process cartridge 70 to the developing unit 4, a force is applied in an opposite direction to the direction (arrow T direction) of the urging force of the urging springs 32 (FIG. 4), so that the photosensitive drum 1 and the developing roller 25 are spaced from each other. As a result, it is possible to prevent deformation or the like of the photosensitive drum 1 at the peripheral side due to continuous urging of the developing roller 25 against the photosensitive drum 1.

Further, when the position of the center of the developing unit 4 is a barycentric position R, the barycentric position R is disposed in the developing unit 4 side rather than the rotation center Q of the developing unit 4 with respect to the gravitation direction. In this case, by the self-weight of the developing unit 4, a force of rotation moment Q1*a* shown in FIG. 9 is applied to the developing unit 4. This direction is a direction of decreasing the urging force of the developing roller 25 toward the photosensitive drum 1. However, in this embodiment, a rotational direction U1 of the developing drive input portion 23 is the same as the rotational direction T of the developing unit 4. As a result, a force of rotation moment Q1*b* is applied from the developing drive input portion 23 to the developing unit 4. This force is applied in a direction of increasing the urging force of the developing roller 25 toward the photosensitive drum 1.

That is, in the conventional constitution, the moment by the self-weight of the developing unit 4 and the moment received by the rotation of the developing roller 25 acted in the direction of decreasing the urging force of the developing roller 25 toward the photosensitive drum 1. For this reason, the urging of the developing roller 25 become unstable in some cases.

On the other hand, in this embodiment, the moment by the self-weight of the developing unit 4 and the moment received by the rotation of the developing drive input portion are applied in opposite directions.

In this way, in the process cartridge 70 having a constitution in which the positions of the rotation center Q and the barycentric position R of the photosensitive unit 4 are in a position relationship such that the urging force of the developing roller 25 toward the photosensitive drum 1 is decreased by the self-weight of the developing unit 4, the following effect is achieved. That is, the rotational direction U1 of the developing drive input portion 23 is set at the direction of increasing the urging force of the developing roller 25 toward the photosensitive drum 1, whereby the urging of the developing roller 25 against the photosensitive drum 1 can be stably performed.

Incidentally, the developer supplying roller 34 is rotated in the same direction as the first direction, and the angle θ2 is close to 90 degrees, so that a force for rotating the developing unit 4 in the first direction is applied from the rotation shaft of the developer supplying roller 34 to the developing unit 4.

Further, in this embodiment, the constitution in which the developing drive input portion 23 is disposed on the axis of the developer supplying roller 34 was described.

Figure 10:
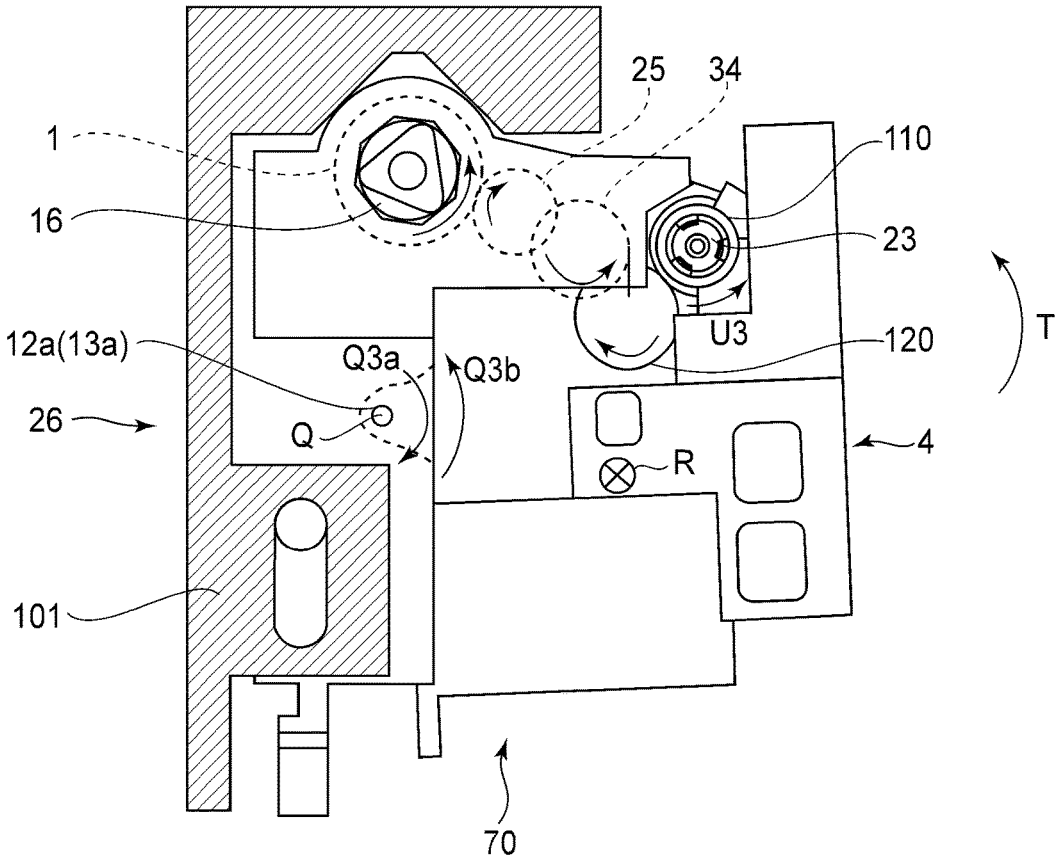
FIG. 10 is a side view showing another constitution example in the embodiment.

However, as shown in FIG. 10, a constitution in which the developing drive input portion 23 is not disposed on the axis of the developer supplying roller 34 may also be employed. That is, when the relationship between the rotation center Q about which the developing unit 4 is rotated and the position and rotational direction of the developing drive input portion 23 is such that the urging force of the developing roller 25 toward the photosensitive drum 1 is increased, a similar effect can be obtained.

In this case, when a driving roller 110 is driven in an arrow U3 direction by the developing drive input portion 23, a rotational driving force is transmitted to a follower roller 120. At this time, the driving roller 110 receives a force from the follower roller 120, so that moment Q3*b* for rotating the developing unit 4 about the rotation center Q is generated. That is, the direction of the moment Q3*b* is opposite to a direction of moment Q3*a* for rotating the developing unit 4 about the rotation center Q. For this reason, a force for decreasing the urging force of the developing roller 25 toward the photosensitive drum 1 can be made small, so that the developing roller 25 can be stably urged.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 273206/2012 filed Dec. 14, 2012, which is hereby incorporated by reference.

What is claimed is:

1. An image forming apparatus comprising:

a main assembly including a driving member for applying a driving force; and a process cartridge detachably mountable to said main assembly, said process cartridge including:

a photosensitive drum;

a photosensitive unit rotatably supporting said photosensitive drum;

a rotatable developing roller for developing an electrostatic latent image on said photosensitive drum;

a rotatable developer supplying roller for supplying developer to said developing roller;

a drive receiving portion for receiving a driving force from said driving member;

a developing unit supporting said developing roller and said developer supplying roller; and a connecting portion connecting said photosensitive unit and said developing unit, said connecting portion being disposed below said drive receiving portion with respect to the direction of gravity in a state that said process cartridge is mounted to the image forming apparatus, wherein said developing unit is movable relative to said photosensitive unit by rotating about said connecting portion between a contacting position in which said photosensitive drum and said developing roller contact each other and a spaced position in which said photosensitive drum and said developing roller are spaced from each other, wherein a rotational moving direction of said drive receiving portion is opposite to that of said developing roller and is the same as a direction of rotation of said developing unit from the spacing position toward the contacting position, and wherein said developer supplying roller is provided between said drive receiving portion and said developing roller on a driving force transmission route.

2. An apparatus according to claim 1, wherein said developer supplying roller is contactable to said developing roller.

3. An apparatus according to claim 1, wherein a center of gravity of said developing unit is below said developing roller with respect to the direction of gravity.

4. An apparatus according to claim 1, wherein said developing unit includes urging means for urging said developing unit toward the contacting position and away from the spaced position.

5. An apparatus according to claim 1, wherein a position of said photosensitive unit is fixed relative to said main assembly in a state that said process cartridge is mounted to said main assembly.

* * * * *